United States Patent [19]

Hirao et al.

[11] Patent Number: 4,550,865

[45] Date of Patent: Nov. 5, 1985

[54] OBLIQUELY-HANDLING NOZZLE FOR AEROSOL

[75] Inventors: Katsumi Hirao, Osaka; Akira Sasaki, Nara, both of Japan

[73] Assignees: Toyo Aerosol Industry Co., Ltd., Tokyo; Kanpe Katei Toryoo Kabushiki Kaisha, Osaka, both of Japan

[21] Appl. No.: 530,589

[22] PCT Filed: Dec. 24, 1982

[86] PCT No.: PCT/JP82/00478

§ 371 Date: Aug. 25, 1983

§ 102(e) Date: Aug. 25, 1983

[30] Foreign Application Priority Data

Dec. 25, 1981 [JP] Japan ..... 56-193841[U]

[51] Int. Cl.[4] ..... B05B 9/04

[52] U.S. Cl. ..... 222/402.21; 239/577; 251/349

[58] Field of Search ..... 239/577; 222/402.21–402.23; 251/149.8, 290, 340, 349

[56] References Cited

U.S. PATENT DOCUMENTS

| | | | |
|---|---|---|---|
| 2,877,480 | 3/1959 | Warren | 239/577 X |
| 3,028,054 | 4/1962 | Beard, Jr. | 222/402.21 X |
| 3,081,918 | 3/1963 | Scoggin, Jr. et al. | 239/577 X |
| 3,169,672 | 2/1965 | Soffer et al. | 222/402.22 X |
| 4,164,959 | 8/1979 | Wurzburger | 251/340 X |
| 4,179,052 | 12/1979 | Abbott | 251/340 X |

FOREIGN PATENT DOCUMENTS

| | | | |
|---|---|---|---|
| 1575040 | 1/1970 | Fed. Rep. of Germany | 239/577 |
| 52-37852 | 2/1976 | Japan . | |

*Primary Examiner*—Andres Kashnikow

*Attorney, Agent, or Firm*—Fleit, Jacobson, Cohn & Price

[57] ABSTRACT

The invention relates to a nozzle connected to an aerosol vessel 1 which has an obliquely-handling valve 3. When a finger piece 18 protruding sideways from the nozzle body 14 is pressed toward the aerosol vessel 1, the obliquely-handling valve 3 can be opened easily by lever action without requiring a strong force, and the aerosol contents can be discharged continuously from a discharge portion 17 onto a target area 27 through a discharge path 16 for a relatively long period of time, without tiring the finger of the user.

3 Claims, 10 Drawing Figures

OBLIQUELY-HANDLING NOZZLE FOR AEROSOL

TECHNICAL FIELD

The present invention relates to a nozzle of an obliquely-handling valve which opens to permit the contents to be discharged when a stem constituting the aerosol valve is tilted. According to the present invention, the contents can be discharged without the need of forcibly pressing a stem of an obliquely-handling valve with thumb or the like from a side surface toward a tilted direction, but simply forefinger. That is, the aersol contents can be discharged easily by tilting the stem by pressing on a finger piece with the without requiring a strong pressure from the thumb or the like as in the past. Therefore, the aerosol contents can be continuously discharged for a relatively long period of time. The nozzle of the invention is particularly suitable for a high viscous contents, such as a caulking agent.

BACKGROUND ART

The contents of an aerosol have heretofore been discharged by pressing a stem of a obliquely-handling valve with the thumb or the liked from a side surface toward a tilted direction, or by pressing a nozzle which is connected to the stem. With this method, the nozzle or the stem must be pressed with the thumb or the like with a strong force, making it hard work to discharge the contents for a long period of time. If the obliquely-handling valve is so designed as to open without requiring a strong force, problems arise with regard to the air-tightness of the aerosol product, and also the aerosol contents may leak if an stem is touched by even a small force by mistake.

The object of the present invention is to provide a nozzle which enables the aerosol contents to be discharged continuously for a relatively long period of time without presenting problems from the standpoint of air-tightness or safety, and which can be opened easily yet requires a relatively large force for opening the obliquely-handling valve.

DISCLOSURE OF THE INVENTION

A fixing portion is provided at the lower end of a nozzle body so as to connect with, and secure the obliquely-handling valve of an aerosol vessel. A discharge path is formed from the fixing portion to a discharge portion of the aerosol contents. A finger piece for opening the obliquely-handling valve protrudes foldably from the side surface of the fixing portion by a thin folded portion. To discharge the aerosol contents, the user places a forefinger on the finger piece, and holds the aerosol vessel with the four other fingers. He then brings a discharge portion close to the target area, and press the finger piece with his forefinger toward the aerosol vessel. Due to the lever action, the obliquely-handling valve receives a strong force in an oblique direction and is opened. Therefore, the aerosol contents are discharged onto the target area from the discharge portion through the discharge path. Therefore, the aerosol contents can be discharged easily without requiring any strong force applied with the thumb or the like as in the past. That is, the aerosol contents can be discharged continuously for a relatively long period of time. This valve is particularly suitable for a high viscous contents such as a caulking agent.

After the discharging the aerosol contents is finished, the finger piece can be raised and engaged with an engagement portion provided on the outer periphery of the nozzle body. An engagement piece is formed on one surface of the finger piece to fix the finger piece to the outer side surface of the nozzle body. Therefore, after the finger piece has been used, the discharge portion can be covered with a cap or the like, the finger piece can be raised and pressed onto the outer side surface of the nozzle body. The engagement piece then engages with the engagement portion and is fixed parallel to the nozzle body, without protruding sideways from the nozzle body, thus making the valve convenient with regard to storage and transport. An over-cap or the like covering the nozzle body can also be fitted to the aerosol vessel.

BEST MODE FOR CARRYING OUT THE INVENTION

Figure 1:
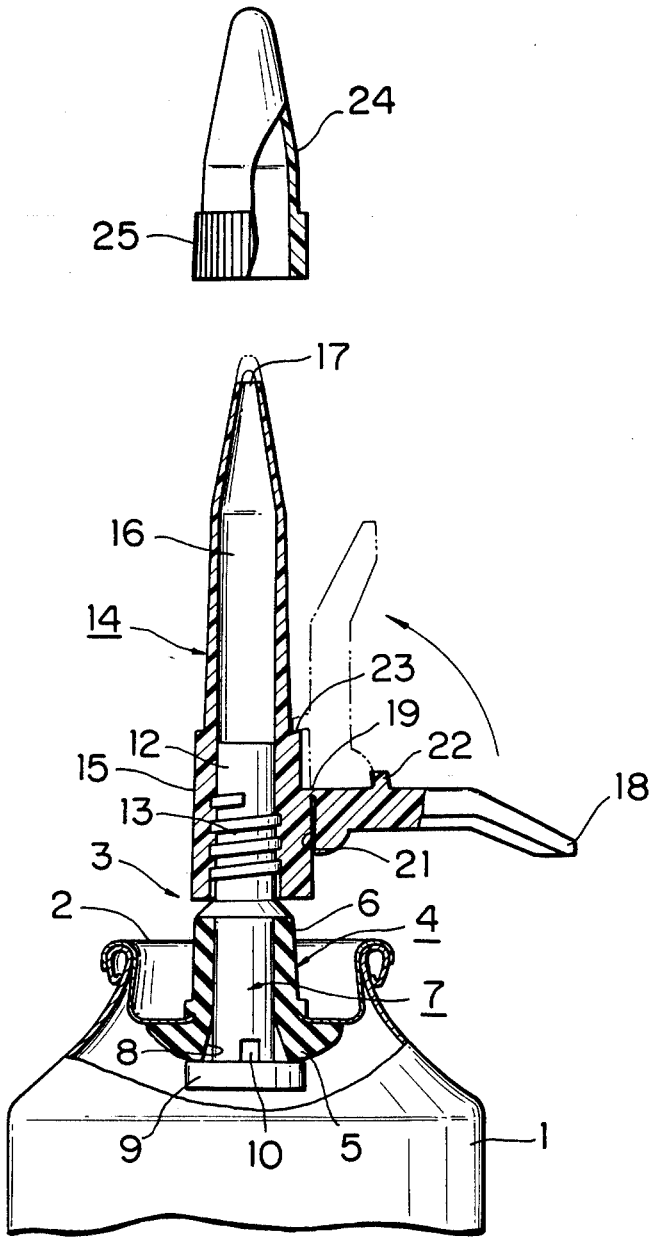
FIG. 1 is a section illustrating the mounting of the obliquely-handling valve.
Figure 2:
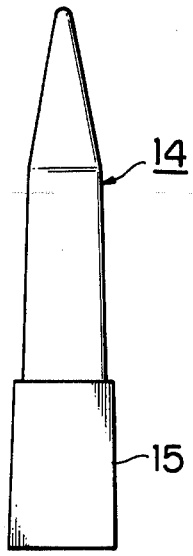
FIG. 2 is a left side view threof.
Figure 3:
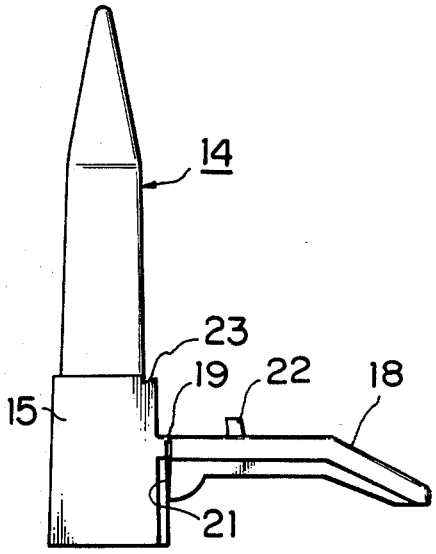
FIG. 3 is a front view threof.
Figure 4:
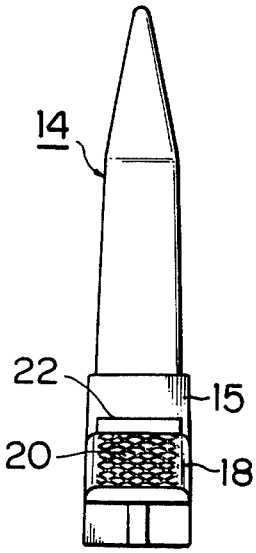
FIG. 4 is a right side view thereof.
Figure 5:
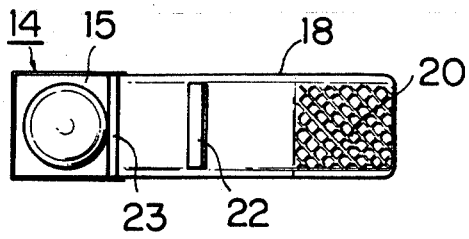
FIG. 5 is a plan view thereof.
Figure 6:
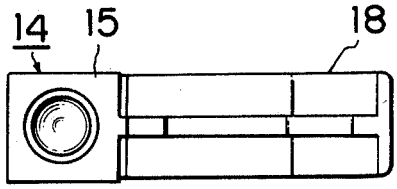
FIG. 6 is a base view thereof.
Figure 7:
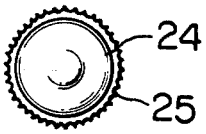
FIG. 7 is a base view of the cap.
Figure 8:
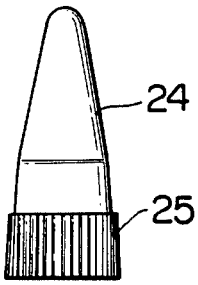
FIG. 8 is a front view of the cap.
Figure 9:
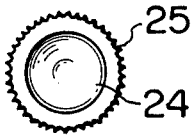
FIG. 9 is a plan view of the cap.

The invention will be described below in further detail in conjunction with the accompanying drawings.

Reference numeral 1 denotes an aerosol vessel which has a cover 2 secured at the upper end thereof, with an obliquely-handling valve 3 formed in the central portion of the cover 2. Reference numeral 4 denotes a gasket made of a soft elastic material which constitutes the obliquely-handling valve 3. An annular flange 5 at one end thereof is in close contact with the inner surface of the cover 2 inside the aerosol vessel 1, and, to form a cylindrical portion 6, the other end protrudes in a cylindrical form from the cover 2 to outward. The inner periphery of the cover 2 is fitted into a portion which connects the cylindrical portion 6 to the annular flange 5. Reference numeral 7 denotes a stem which passes through an insertion hole 8 formed in the gasket 4 in the axial direction thereof. A closing flange 9 widened at one end is in air-tight contact with the outer surface of the annular flange 5 of the gasket 4, and an introduction hole 10 for introducing the aerosol contents is made in the inner surface thereof which is stopped up with the annular flange 5. When the stem 7 is pressed sidewards and tilted, the annular flange 5 partly separates from the closing flange 9, so that the aerosol contents are introduced through the separated gap and can be discharged through the introduction hole 10.

Reference numeral 12 denotes the protruding end of the stem 7 which protrudes outward from the gasket 4. The protruding end 12 has a screw groove 13 formed around the periphery thereof, and detachably secures a fixing portion 15 of a nozzle body 14. Reference numeral 16 denotes a discharge path which is formed in the nozzle body 14 from the fixing portion 15 to a discharge hole 17 so as to connect with the stem 7. When the aerosol contents are to be discharged, the discharge hole 17 must be made previously by cutting off the end of the nozzle body 14. Reference numeral 18 denotes a finger piece which protrudes foldably from the side surface of the fixing portion 15 by an integral foldable web that defines a hinge 19 that is integral with fixing portion 15 and finger piece 18. The outer end of the finger piece 18 is slightly tilted, a rough portion 20 for preventing slipping is formed on the upper surface thereof, and a butting surface 21 is touched against the outer surface of the fixing portion 15 when the finger piece 18 is lowered to a position nearly at right angles to the axial direction of the fixing portion 15. When the rough portion 20 formed on the upper surface of the finger piece 18 is pressed, the obliquely-handling valve 3 is opened by the action of the lever. Reference numeral 22 denotes an engagement piece protruding from one surface of the finger piece 18. When the finger piece 18 is tilted in the direction of the folded poriton 19 so that the engagement piece 22 is raised above the thin foldable web 19 and fixed on the outer side surface of the nozzle body 14, the engagement piece 22 engages with an engagement portion 23 formed on the outer periphery of the nozzle body 14, so that the finger piece 18 is held at the raised position. Reference numeral 24 denotes a cap for hermetically covering the discharge hole 17 when the nozzle body 14 is not being used, it has a rough area 25 on the circumference thereof to prevent slipping.

Figure 10:
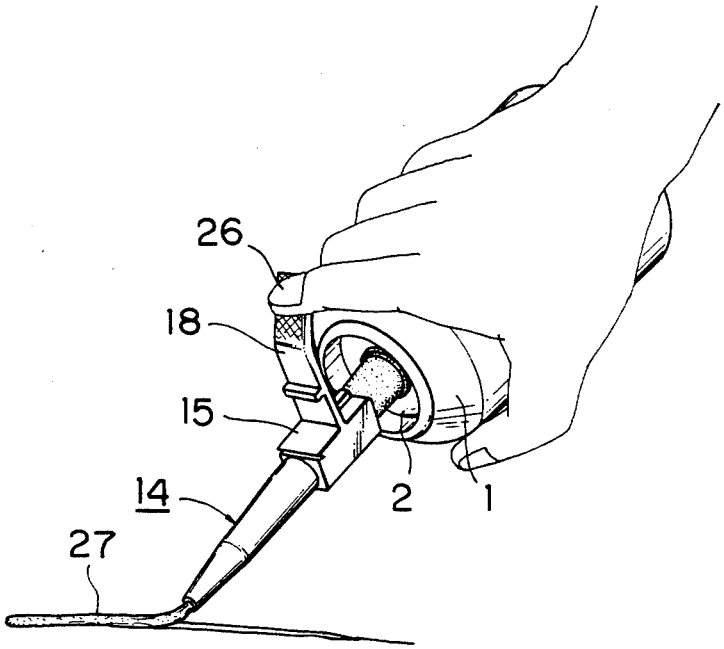
FIG. 10 is a perspective view illustrating the obliquely-handling valve being used.

To use the thus constructed obliquely-handling nozzle to discharge the aerosol, the fixing portion 15 is fitted with the screw groove 13 of the stem 7, the finger piece 18 is raised to a position nearly at right angles to the nozzle body 14, a forefinger 26 is placed on the finger piece 18 as shown in FIG. 10, and the discharge hole 17 is brought close to a target area 27 while the aerosol vessel 1 is held with the four other fingers. The finger piece 18 is then pressed by the forefinger towerd the aerosol vessel 1. A strong tilting force is applied to the obliquely-handling valve 3 due to the lever action, and the closing flange 9 of the stem 7 separates partly from the annular flange 5 of the gasket 4. The contents, therefore, are discharged onto the target area 27 through the introduction hole 10, stem 7 and discharge path 16. Due to the utilizing the lever action, a large tilting force is produced from a small pressing force, and the aerosol contents can be discharged continuously for a relatively long period of time. After the discharging the aerosol contents is finished, the discharge hole 17 is covered with a cap 24, the finger piece 18 is raised and is pressed onto the outer side surface of the nozzle body 14 so that the engagement piece 22 engages with the engagement portion 23, and the finger piece 18 is fixed nearly parallel to the axial direction of the nozzle body 14, the finger piece 18 does not protrude from the side surface of the nozzle body 14, so it is convenient for storage and transport. An over-cap or the like coveing the nozzle body 14 can be fitted to the aerosol vessel 1.

FIG. 10 illustrates an example wherein the contents are a caulking agent.

INDUSTRIAL APPLICABILITY

According to the obliquely-handling nozzle for aerosol of the presnet invention as described above, the ovliquely-handling valve of an aerosol vessel can be tilted easily without requiring a strong force. Therefore, a nozzle can be connected to an aerosol vessel with an obliquely-handling valve, so that the aerosol contents can be discharged continuously for a relatively long period of time. Accordingly, viscous aerosol contents such as caulking agents, and adhesive agents and the like can be discharged effectively onto the target area continuously or intermittently periods of time, without tiring the user.

What is claimed is:

1. A discharge nozzle for an aerosol container having a discharge opening with a closure including a stem, the closure operable upon tilting of the stem relative to the discharge opening to provide a discharge path from the interior of the container to the closure, said nozzle comprising:

(a) an elongated nozzle body including means to removably secure said body to said closure, said body being generally tubular to provide a product discharge path, the outer surface of said tubular body including an engagement portion;

(b) an elongated finger piece extending laterally outwardly from said tubular body and secured thereto by a thin foldable web that defines a hinge, said finger piece including engagement means spaced outwardly from said web and engageable with said engagement portion of said nozzle body when said finger piece is pivoted about said web to bring said elongated finger piece adjacent to the outer surface of said nozzle body to retain said finger piece along said nozzle body when the nozzle is not ln use, said finger piece also including an abutting surface adapted to abut the outer surface of said nozzle body when said finger piece is in laterally outwardly extending relationship with said nozzle body to define an operating position, whereby finger pressure on said finger piece in a direction toward the aerosol container when the finger piece is in the operating position causes tilting of the closure to permit the dispensing of product through the nozzle body.

2. A discharge nozzle according to claim 1, wherein the finger piece protrudes from the side surface of the nozzle body at substantially a right angle to the axial direction of the nozzle body when the nozzle is in the operating position, and is fixed nearly parallel to the axial direction of the nozzle body when said engagement means engages with said engagement portion when the nozzle is not in use.

3. A discharge nozzle according to claim 2, wherein said web is integral with each of said nozzle body and said finger piece.

* * * * *

UNITED STATES PATENT AND TRADEMARK OFFICE

CERTIFICATE OF CORRECTION

PATENT NO. : 4,550,865

DATED : November 5, 1985

INVENTOR(S) : Katsumi Hirao and Akira Sasaki

It is certified that error appears in the above-identified patent and that said Letters Patent is hereby corrected as shown below:

Column 1, line 14, after "simply" insert --by tilting the stem by pressing on a finger piece with the--; and bridging lines 15 and 16, delete "by tilting the stem by pressing on a finger piece with the".

Column 4, line 38, delete "ln" and insert therefor --in--.

Signed and Sealed this

First Day of April 1986

[SEAL]

*Attest:*

DONALD J. QUIGG

*Attesting Officer*

*Commissioner of Patents and Trademarks*